US007501042B2

(12) United States Patent
Manttari

(10) Patent No.: US 7,501,042 B2
(45) Date of Patent: Mar. 10, 2009

(54) METHOD AND ARRANGEMENT IN CONNECTION WITH A CHEMICAL RECOVERY BOILER

(75) Inventor: Ilkka Manttari, Varkaus (FI)

(73) Assignee: Andritz Oy, Helsinki (FI)

( * ) Notice: Subject to any disclaimer, the term of this patent is extended or adjusted under 35 U.S.C. 154(b) by 466 days.

(21) Appl. No.: 11/275,555

(22) Filed: Jan. 13, 2006

(65) Prior Publication Data

US 2006/0157087 A1 Jul. 20, 2006

(30) Foreign Application Priority Data

Jan. 17, 2005 (FI) ..... 20050052

(51) Int. Cl.
*D21C 11/12* (2006.01)

(52) U.S. Cl. ..... 162/30.1; 162/272; 162/239

(58) Field of Classification Search ..... 162/30.1, 162/272, 239
See application file for complete search history.

(56) References Cited

U.S. PATENT DOCUMENTS 3,122,421 A * 2/1964 Gettle ..... 137/3
4,280,982 A 7/1981 Shindome et al.
4,421,596 A * 12/1983 Hogberg ..... 162/30.11
4,659,020 A * 4/1987 Kutrow ..... 239/752
4,706,324 A * 11/1987 Goodspeed ..... 15/246
5,976,319 A * 11/1999 Paju et al. ..... 162/30.1

FOREIGN PATENT DOCUMENTS

FI 92727 6/1991
SE 524 274 7/2004

* cited by examiner

*Primary Examiner*—Mark Halpern
(74) *Attorney, Agent, or Firm*—Nixon & Vanderhye P.C.

(57) ABSTRACT

The present invention relates to a method in connection with smelt removal form a recovery boiler, whereby the smelt is removed from the boiler via a smelt spout surrounded outside the boiler by a hood and a dispersion medium, preferably steam, is fed into the smelt flow falling from the smelt spout for shattering the smelt flow. An essential characteristic is that at least one wall of the hood is washed with liquid so that the liquid first flows downwards on the outer surface of the hood wall and is led into the interior of the hood via at least one trough-like member arranged on the outer surface of the wall and openings in the wall so that the liquid further flows downwards on the inner surface of the wall. The invention also relates to an arrangement for washing the hood and the feeding device for the dispersion medium.

16 Claims, 3 Drawing Sheets

METHOD AND ARRANGEMENT IN CONNECTION WITH A CHEMICAL RECOVERY BOILER

RELATED APPLICATION

This application claims priority to Finnish Patent Application No. 20050052 filed on Jan. 17, 2005 which is incorporated by reference.

BACKGROUND OF THE INVENTION

The present invention relates to a method and an arrangement in connection with smelt removal from a recovery boiler, whereby the smelt is removed from the boiler via a smelt spout surrounded outside the boiler by a hood, and a dispersion medium, preferably steam, is sprayed via a nozzle into the smelt flow falling from the smelt spout for shattering the smelt flow. Specifically, the invention relates to a washing arrangement for washing the hood and the feed device for the dispersion medium.

An essential apparatus in the recovery cycles of sulfate and other Na-based pulping processes is the recovery boiler for waste liquor containing cooking chemicals, such as a soda recovery boiler, wherein the chemicals are processed into a form suitable for recovery purposes. In a sulfate process, the most important chemicals are sodium and sulfur. Organic substances dissolved during the digestion in the waste liquor are combusted in the furnace of the boiler generating heat, which is utilized on one hand for converting inorganic compounds of the waste liquor back into chemicals to be used in cooking and on the other hand for generating steam. The inorganic substance in the waste liquor melts in the high temperature of the furnace and flows as smelt onto the bottom of the furnace.

From the bottom of the boiler the chemical smelt is led via cooled smelt spouts into a tank, where it is dissolved in water or weak white liquor for forming soda lye, i.e. green liquor. In the sulfate process, the main components of smelt and thus green liquor are sodium sulfide and sodium carbonate. The green liquor is then led to a causticizing plant, where white liquor is produced therefrom.

The hot smelt flow causes crashes or explosions when falling into a dissolver tank. The noise is due to explosion reactions between the smelt and water as the smelt gets into contact with the green liquor in the dissolver tank. The temperature of the smelt is in the order of 750-820° C., and the temperature of the green liquor (or weak white liquor), containing mainly water, in the dissolver tank is in the order of 70-100° C.

The intensity of the explosion reactions taking place in the dissolving tank may be regulated by shattering the smelt flow exiting the smelt spout into small parts before it gets into contact with the green liquor in the dissolving tank.

Smelt shattering is most often done by directing a steam jet and/or green liquor jet against the smelt flow exiting the smelt spout. Also a jet formed of mist generated from air and water has been suggested. The most common smelt shattering method practiced in Finland is the use of low or medium pressure steam.

The part of the smelt spout extending outside the furnace wall is usually surrounded by a closed hood, i.e. protective housing, which prevents liquid and smelt splashes and vent vapors from entering the surroundings. The bottom part of the hood is in connection with a smelt dissolving tank located underneath the smelt spout, which tank receives the smelt from the spout and in which tank the smelt is dissolved in liquid forming green liquor. The nozzles spraying the medium dispersing the smelt flow are typically installed in the hood and directed towards the smelt flow falling from the spout. Smelt splashes may enter and stick in the hood and on the walls of the dissolving tank. Smelt cakes thus formed cause explosions when falling in the dissolving tank. Thus, the hood is subject to hot and corroding conditions caused by the smelt. Therefore, the interior of the hood has been washed, typically with weak liquor. The circumference of the hood may be provided with wash distributor pipe for washing off splash smelt from the walls of the hood and for preventing smelt deposits.

Splash smelt can also enter a nozzle spraying a smelt flow dispersing medium, such as steam, and thus shorten the operating life of the nozzle.

SUMMARY OF THE INVENTION

An improved hood arrangement has been developed to reduce the effects of the disadvantageous conditions caused by the smelt on the hood. The hood arrangement provides increased protection of the shattering nozzle against splash smelt.

At least one wall of the hood arrangement is treated with a liquid so that the liquid flows first downwards on the outer surface of the hood wall and is then directed via wall openings into the interior of the hood, so that the liquid flows further downwards on the inner surface of the wall.

A method for washing the hood has also been developed. Preferably, washing the hood is effected so that at least one tubular member, such as a washing pipe, having holes at the bottom edge, is provided on the outer wall or walls of the hood. Water or other suitable liquid is led into the tubular member. The hood walls typically have a sloping portion, below which the walls are vertical. The tubular member, such as a washing pipe, is preferably mounted on the upper part of the sloping portion of the outer wall of the hood, whereby the liquid flows through the holes and downwards on the sloping surface. Thus the flowing liquid cools the outer surface of the hood. Each wall of the hood may be cooled by washing. The essentially horizontal washing pipe is preferably located approximately at the level of the smelt spout on the side of the hood.

At the bottom edge of the sloping portion the liquid flow is collected in a trough- or chute-like member, which preferably is formed by mounting an elongated plate against the sloping surface at a suitable angle so that the liquid is directed via holes, slots or corresponding openings in the hood wall to the interior of the hood. There the liquid flows downwards, washing and cooling the inner surface. Finally the liquid ends up in the dissolving tank beneath the hood. Washing of the inner hood surfaces prevents smelt cakes or deposits formed of splash smelt from accumulating on the walls. Smelt cakes falling in the dissolving tank increase the intensity of explosion reactions, and thus also noise.

The feeding device for the smelt flow shattering medium, which device includes a feed pipe and a shattering nozzle at the end of the pipe and is located inside the hood, is also subject to fouling caused by splash smelt, which shortens the operational life of this device as well. To remove splash melt, a washing liquid pipe has been mounted around the feed pipe. The upper surface of the washing pipe is provided with at least one hole, through which water or some other suitable liquid is released and washes the part of the pipe located inside the hood, thus keeping it clean. The end of the washing pipe adjacent to the shattering nozzle is closed expect for at least one opening arranged at the upper edge, via which opening the washing liquid flows further to the nozzle, keeping also the nozzle part clean.

Preferably both the hood and the feed device for the dispersion medium are washed with water or weak white liquor. Some other suitable wash liquid may also be used. The wash liquid should not contain any substance which might clog the holes in the washing pipe. Additionally, the wash liquid should be suitable for smelt dissolving and for formation of green liquor in the dissolving tank.

SUMMARY OF THE DRAWINGS

The present invention is described in more detail with reference to the appended figures, of which.

DETAILED DESCRIPTION OF THE INVENTION

Figure 1:
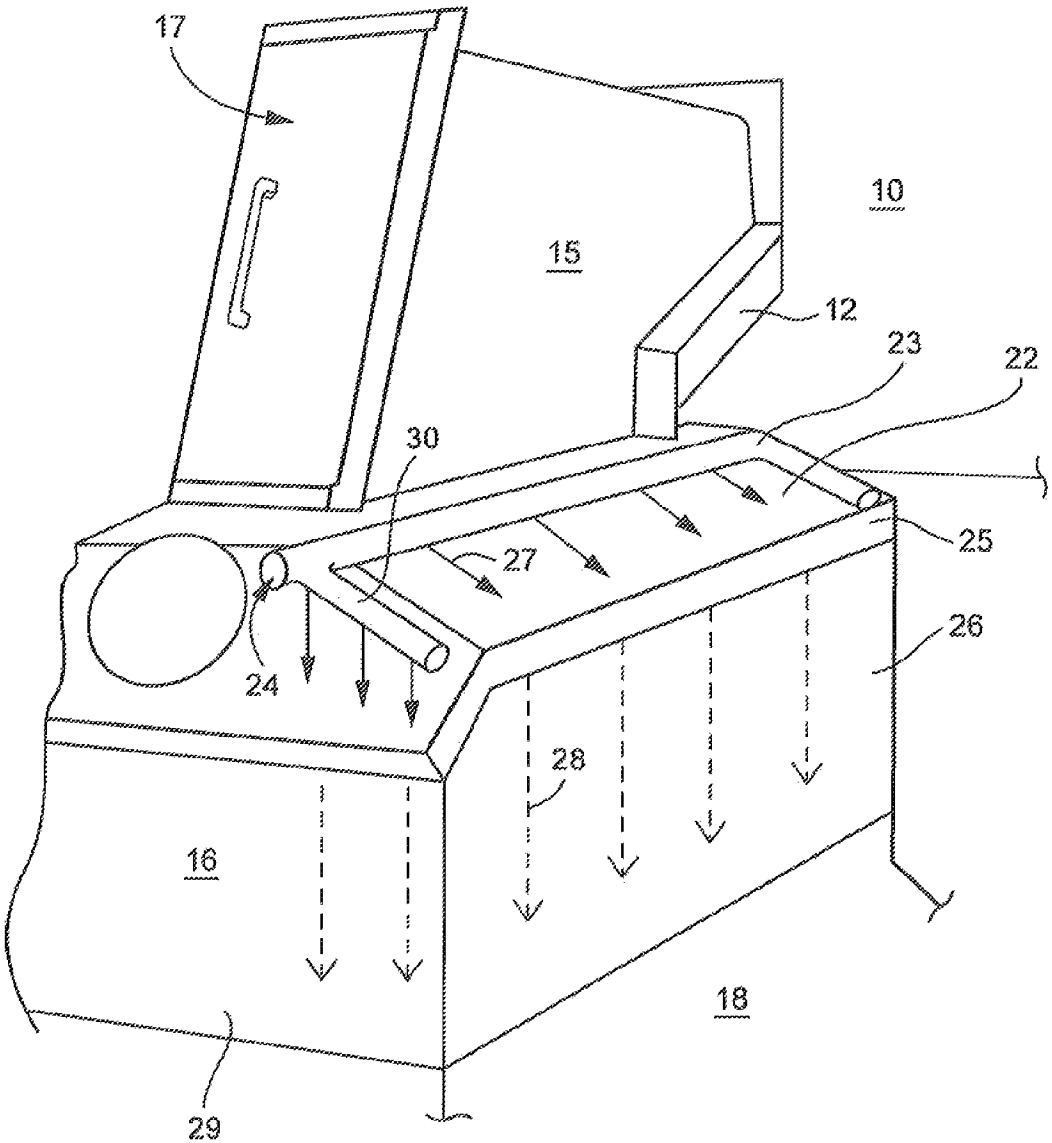
FIG. 1 is a font and side perspective view of an arrangement according to a preferred embodiment of the invention.
Figure 2:
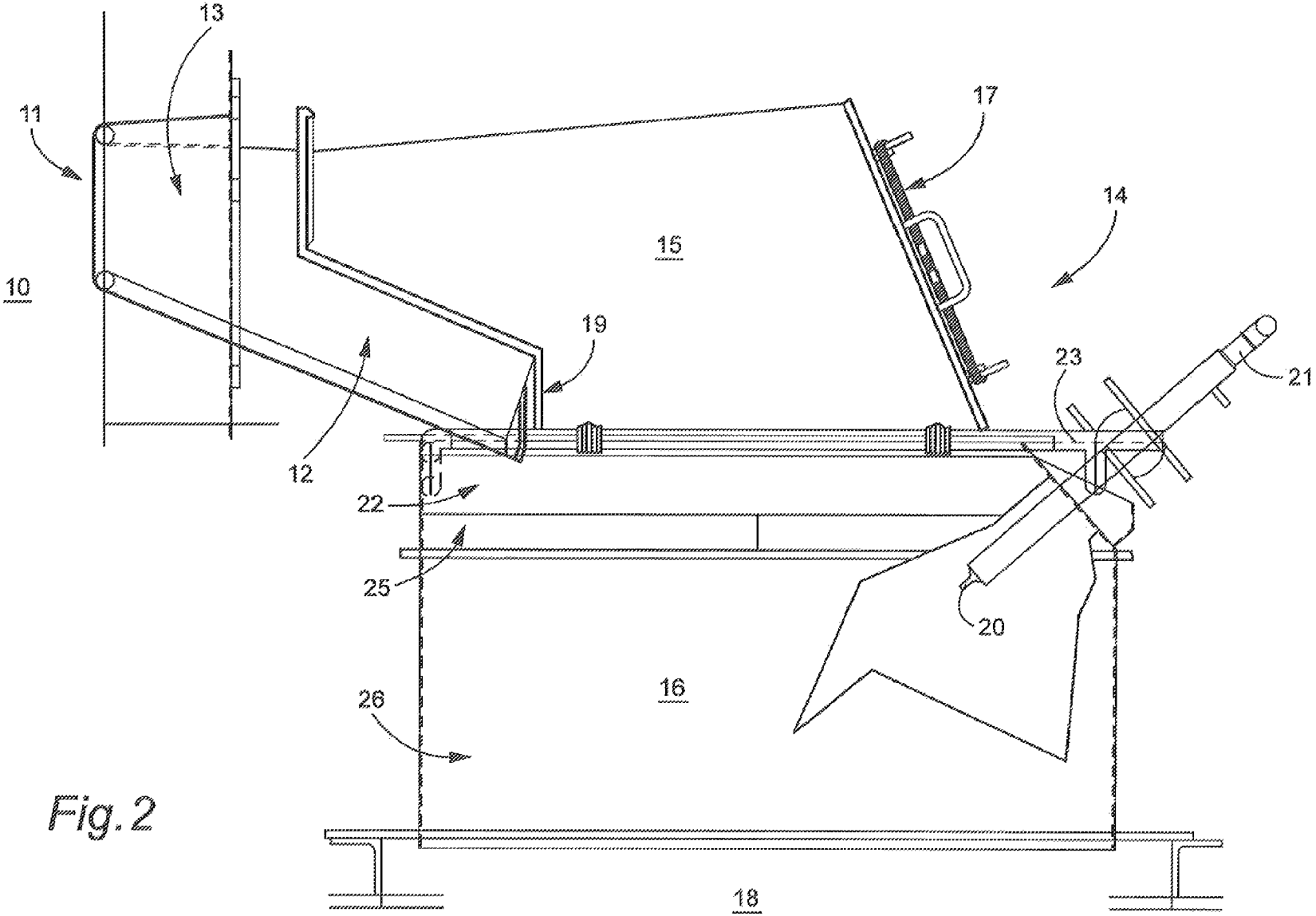
FIG. 2 is a side view shown in partial cross-section of the arrangement show in FIG. 1.

In FIGS. 1 and 2, the furnace forming the lower part of a recovery boiler of a pulp mill is identified with reference numeral 10. An opening 11 has been formed on the boiler wall immediately above the lower part of the furnace, in which opening a stationary end 13 of a smelt spout 12 has been mounted. The smelt spout part, which extends outside the boiler wall, is surrounded by an essentially closed hood, i.e. protective housing 14 comprising an upper part 15 and a lower part 16. The upper part further includes a lid 17. The hood prevents liquid and smelt splashes from entering the surroundings of the smelt spout. The lower part 16 of the hood is connected to a smelt dissolving tank 18 located below the smelt spout, in which tank the smelt dissolves in liquid, such as in weak white liquor, forming green liquor.

The hot smelt mass flows from the lower part of the furnace via opening 13 into smelt spout 12 and falls from the free end 19 of the smelt spout into the dissolving tank 18. For shattering the smelt mass to smaller droplets a dispersion medium jet is directed via nozzle 20 to the smelt flow. Typically the medium is low or medium pressure steam, which is led into the nozzle via feed pipe 21. The pipe 21 is further connected to a medium feed source (not shown).

The upper part 22 of the walls of the lower part 16 of the hood according to FIGS. 1 and 2 is sloping. The upper edge of each side wall of the lower part 16 is provided with a horizontal pipe 23, which receives washing liquid via conduit 24. The bottom edge of the pipe 23 is provided with perforation, holes, openings or apertures, via which washing liquid flows (arrows 27) along the outer surface of the hood into a trough- or chute-like member 25, which in FIG. 1 is formed by arranging an elongated plate against the sloping surface at a suitable angle. At the bottom of the trough 25 the wall of the hood has holes, slots or corresponding openings along the whole length of the side wall. Through the openings the washing liquid flow is directed inside the hood, whereby the elongated plate acts as a kind of flow-restricting or flow-directing plate. Inside the hood the liquid flows downwards (arrows 28) along the inner surface of the hood wall. Wall 26 is in this case essentially vertical. FIG. 1 illustrates also the washing of the front wall 29 of the hood via branch 30 of pipe 23 in a corresponding way.

The washing of the outer surface of the hood cools the hood walls, which are heated especially by the hot smelt flowing from the boiler. On the inner surface, the flowing liquid not only cools but also removes smelt splashes from the walls.

Figure 3:
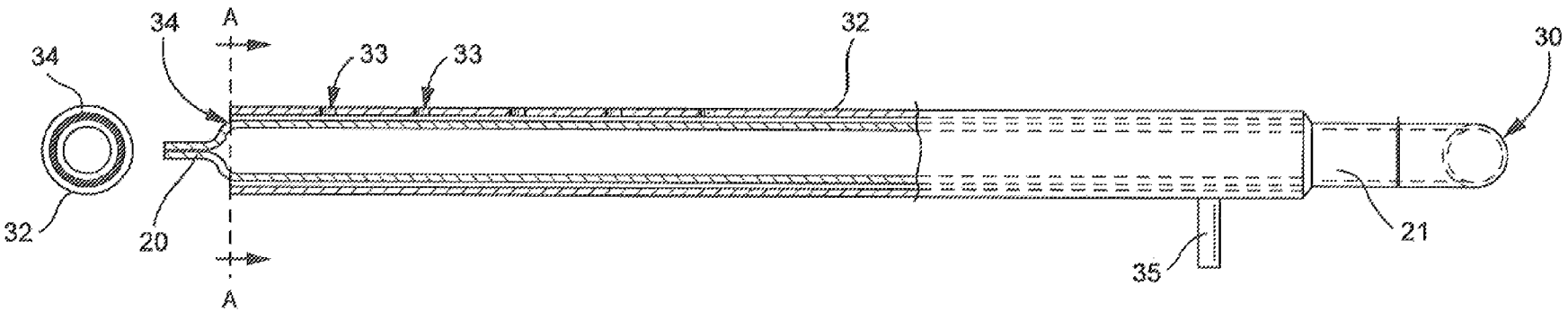
FIG. 3 illustrates an arrangement of the feed device for the smelt flow dispersing medium according to a preferred embodiment of the invention.

FIG. 3 illustrates a feed device for the smelt flow dispersing medium, which device comprises a dispersing medium feed pipe 21 and a nozzle 20 connected at the end. Steam or other medium 30 is introduced in the feed pipe. In this case the nozzle 20 has been formed by flattening the end of the pipe. This way, the obtained medium jet is efficient along the whole length thereof.

A washing liquid pipe 32 has been mounted around the feed pipe 21, said washing liquid pipe extending along the length of the feed pipe inside the hood, whereby the nozzle part remains free. The upper surface of the washing pipe is provided with holes 33, through which water or other suitable liquid is discharged and washes the part of the pipe inside the hood, thus keeping it clean. The washing liquid is introduced via channel 35 and it flows in an annular passage between the feed pipe and the washing pipe, and further via holes 33 to the outer surface of the washing pipe.

The end of the washing pipe 32 adjacent to the shattering nozzle is closed except for an opening 34 arranged at the upper edge, wherethrough the washing liquid flows further onto the surface of the nozzle 20, thus keeping also the nozzle part clean. The amount of washing liquid used is so small that it can be used continuously.

The invention is not limited to a certain, above described construction or form of the hood, but it may be applied in connection with other kinds of hoods as well, where the arrangement according to the invention can be mounted. Further, the scope of the invention is not limited by the fact that what is here referred to as hood may in some cases be referred to as a part of the smelt-dissolving tank.

By means of the invention the reliability and operational life of devices adjacent to the smelt spout, i.e. the hood and the shattering nozzles, are increased While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method for use in smelt removal from a recovery boiler, said method comprising:

discharging smelt from the boiler to a smelt spout extending to a hood external to the boiler;

spraying a dispersion medium on a smelt flow dropping from the smelt spout to shatter the smelt flow, and discharging onto at least one wall of the hood a wash liquid, wherein the liquid flows downwards across an outer surface of the hood, passes through wall openings in the wall of the hood, to an interior surface of the hood and flows across the interior surface.

2. The method according to claim 1 further comprising washing a smelt flow dispersion medium nozzle with a liquid.

3. The method according to claim 1 wherein the wash liquid is water.

4. The method according to claim 1 wherein the wash liquid is weak white liquor.

5. The method according to claim 1 further comprising collecting the wash liquid flowing over the outer surface in a collection channel and passing the collected wash liquid to the inner surface.

6. The method according to claim 1 wherein the wash liquid flows across a sloped portion of the outer surface and a vertical portion of the inner surface.

7. An assembly for smelt removal from a recovery boiler comprising:

a smelt spout to receive smelt removed from the boiler;

a hood external to the boiler and enclosing at least a portion of the spout;

a dispersing medium injector projecting into the hood to spray a dispersing medium on a smelt flow discharging from the smelt spout to shatter the smelt flow, and a tubular member attached to the hood and including at least one fluid discharge port arranged to discharge a wash liquid on an outer surface of the hood such that the wash liquid flows downwards along the outer surface to a trough member attached to the outer surface and below the tubular member, wherein the trough member includes at least one conduit to direct the wash liquid from the outer surface to an interior surface of hood such that the wash liquid flows downwards along the interior surface.

8. The assembly of claim 7 wherein the outer surface is sloped, the interior surface is vertical and the trough member is attached to the hood at a transition between the sloped and vertical surfaces.

9. The assembly of claim 7 wherein the discharge port includes at least one of apertures, slots and openings in the tubular member.

10. The assembly of claim 7 wherein the trough member a collection channel adjacent the outer surface and arranged to collect wash liquid flowing across the outer surface.

11. The assembly of claim 7 wherein the trough member is a channel extending a length of at least one wall of the hood at a transition between an upper sloped surface of the hood and a substantially lower vertical surface of the hood.

12. A method for removing smelt from a recovery boiler comprising:

discharging the smelt from the boiler to a smelt spout extending outside the boiler into a hood;

spraying a dispersing medium into the smelt flow falling from the smelt spout, wherein the dispersing medium is sprayed from a dispersion nozzle attached to a feed pipe, and discharging a washing liquid onto a section of the feed pipe within the hood from a washing liquid pipe arranged around the feed pipe, wherein an upper section of the washing liquid pipe includes at least one inlet port to receive the washing liquid which passes through the washing liquid pipe and to a discharge port of the pipe, wherein the discharge port is adjacent he section of the feed pipe receiving the washing liquid.

13. The method of claim 12 wherein the section of the feed pipe receiving the washing liquid includes the attachment to the dispersion nozzle, and the washing liquid pipe is an annular passage having an open end at the upper section and another open end at the discharge port.

14. A method according to claim 12 wherein the smelt flow dispersion medium nozzle is further washed with liquid.

15. The method according to claim 12 wherein the wash liquid is water.

16. The method according to claim 12 wherein the wash liquid is weak white liquor.

* * * * *